United States Patent [19]

Fischer

[11] 4,047,857

[45] Sept. 13, 1977

[54] ROTARY PISTON ENGINE

[76] Inventor: Arno Fischer, Pfistermuhle, 8121 Rottenbuch, Upper Bavaria, Germany

[21] Appl. No.: 628,632

[22] Filed: Nov. 4, 1975

[30] Foreign Application Priority Data

Nov. 4, 1974 Germany ..... 2452288

[51] Int. Cl.[2] ..... F04C 5/00; F04C 1/00

[52] U.S. Cl. ..... 418/153; 418/176

[58] Field of Search ..... 418/151, 153, 156, 176

[56] References Cited

U.S. PATENT DOCUMENTS

| | | | |
|---|---|---|---|
| 799,875 | 9/1905 | Smith | 418/176 |
| 2,507,357 | 5/1950 | Stoner | 418/176 |
| 2,636,478 | 4/1953 | Smyser | 418/153 |
| 2,636,479 | 4/1953 | Smyser | 418/153 |
| 2,843,049 | 7/1958 | Sherwood | 418/153 |
| 3,211,103 | 10/1965 | Kiekhaefer | 418/153 |
| 3,303,790 | 2/1967 | McCray | 418/153 |
| 3,594,106 | 7/1971 | Garrison | 418/153 |

*Primary Examiner*—Carlton R. Croyle
*Assistant Examiner*—Leonard Smith
*Attorney, Agent, or Firm*—Silverman & Cass, Ltd.

[57] ABSTRACT

A rotary piston engine has a plurality of sealing elements, each of which includes a cylindrical stationary bearing portion pressed into the rotor and at least one curved blade extending therefrom. The curved blade engages the race of the stator and is adapted to pivot into a curved recess in the rotor. The sealing elements may have a second curved blade extending from the stationary bearing portion oppositely from the first blade. The underneath side of the blades nearest the stator may have longitudinal grooves provided therein to facilitate their lifting from the stator surface. The sealing elements may be made from plastic or may be a two piece construction of plastic and metal.

12 Claims, 11 Drawing Figures

Fig.3
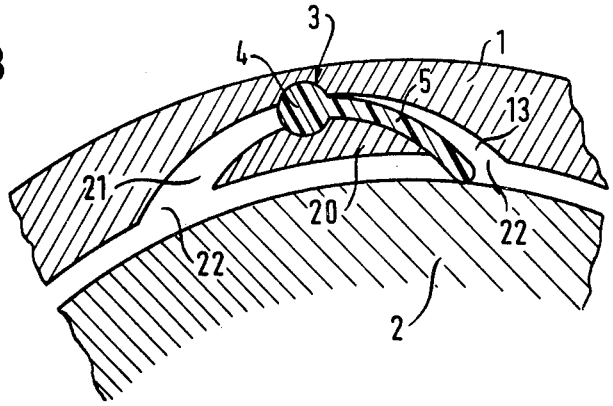
Fig.4
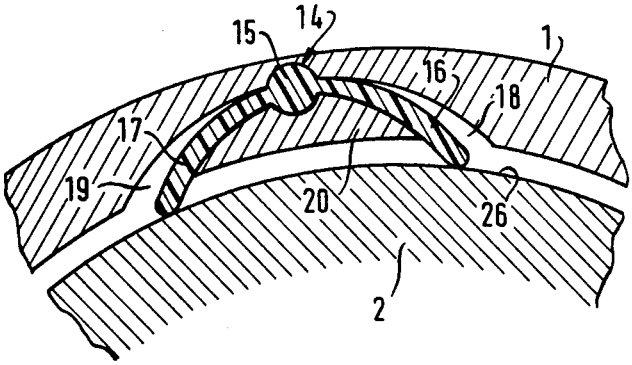
Fig.5
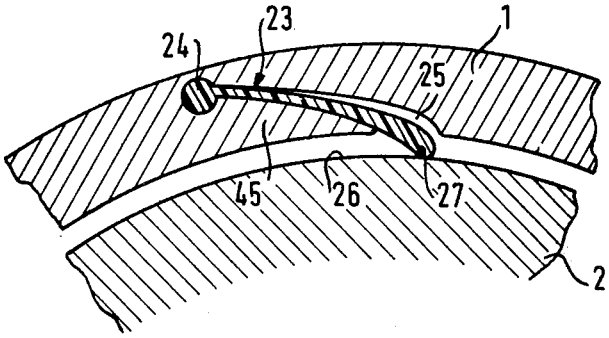
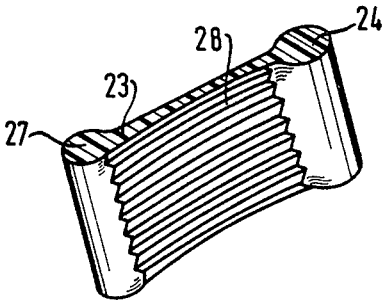
Fig.6

ROTARY PISTON ENGINE

BACKGROUND OF THE INVENTION

This invention relates to a rotary piston engine comprising working parts positioned in a rotor which serve at the same time as sealing elements by sealingly engaging a race provided on the stator, the stator comprising partitions or separating portions in contact with the rotor and having feed and discharge ports arranged between working chambers.

DESCRIPTION OF THE PRIOR ART

A number of rotary piston engines are known in the prior art, wherein the working parts are designed as spring-biased slides which with the aid of the spring are caused to slide with their working surface on a curve track. However, on the one hand, the working life of such parts is rather short and, on the other hand, their sealing action is not sufficient so that the effectiveness of this rotary piston engine of the prior art is likewise reduced.

Furthermore, a rotary piston engine is known from the German Offenlegungsschrift DT-OS 2,163,423, in which the working parts are designed as piston slides mounted in the rotor for rotary oscillation. This allows of a substantially higher rpm and improves the effectiveness of the engine. Nevertheless, the mounting of the working parts in the rotor requires a high structural expenditure.

SUMMARY OF THE INVENTION

The present invention provides for a rotary piston engine of the type noted earlier, in which the working parts positioned in the rotor are designed such that they accomplish a substantial increase in the degree of effectiveness of the engine and yet are of simple design.

According to the invention, this object is achieved by providing the working parts as stationary sealing elements comprising at least one flexible blade adapted to engage the race of the stator. The advantageous result is that the working parts are stationary members with the sealing action being achieved alone by the flexibility of the blade relative to the working chamber. Thus, a substantially simplified structure of the working parts as compared with the prior art is achieved.

According to a further development of the invention, each sealing element may comprise a stationary bearing portion disposed in the rotor. Said stationary bearing portion is secured within the rotor e.g. in press fit so that only the blade in its sealing function is flexible relative to the race of the stator.

The invention further includes features as follows: Each sealing element may be provided with two blades with an intermediate stationary bearing portion. This two-bladed design of the sealing elements enables the direction of rotation of the rotary piston engine to be reversible without requiring any particular technical handling to this effect.

The stationary bearing portion may be firmly pressed into the rotor with the joining blade being adapted to pivot within a recess formed in the rotor between its stator race engaging position and its relative disengaged position. This results in a most simple structure of the sealing element which functions at the same time as the working part.

The underside of each blade may be provided with longitudinal grooves. Through these longitudinally extending grooves, which may be provided either on the working part or on the abutment, the pressure medium, e.g. oil can pass between the working part and the abutment thus facilitating substantially the lifting of the blade.

The grooves may extend between the stationary bearing portion and a sealing lip formed at the end of the blade, viz. in the area where an undesired adherence of the blade on the abutment is most likely to occur. Such undesired adherence is satisfactorily avoided by means of said grooves.

The blade receiving recess in the rotor may be curved, and such curve can e.g. be cut out from the rotor in a simple manner by using a specially formed milling cutter. This facilitates the working of the recess considerably.

Furthermore, the curved recess may be provided in form of a passage with an enlarged end portion, which passage may be worked by using two appropriate milling cutters. Thus, the recess for accommodating the sealing element therein is capable of being most economically produced.

According to still another embodiment of the invention, the two-bladed sealing element may be controllable as regards the engagement of either blade on the race of the stator. Here, the pivoting movement of the sealing blade may be controlled by outside elements so that both in clockwise and in counterclockwise direction the functionally proper blade is caused to engage the associated race.

Reversal may be brought about by means of cam formations with the bearing portion of the sealing element being mounted within a rotor portion that is adapted for rotary oscillation. This results advantageously in an automatic control of the pivoting movement of the blade.

The control may also be effected through the direction of rotation of the rotor: when the rotor moves in clockwise direction, one blade is in engagement, when it moves in counterclockwise direction, the one blade will automatically lift off and the other blade will become effective.

Furthermore, the sealing elements may be made from a two-layer material. One layer thereof may e.g. be made from plastic and the other from metal. Sealing elements made from such two-layer material have a long working life.

According to a further embodiment of the invention, a single-bladed sealing element may extend through the entire passage and be supported at the one end thereof and, at the opposite end either engage with their sealing lip the stator race or be received in a recess in said passage. This design, too, assures a simple but safe action of the inventive sealing element.

BRIEF DESCRIPTION OF THE DRAWINGS

FIGS. 3, 4 and 5 illustrate different embodiments of the sealing element according to the invention;

FIG. 6 is a perspective view of a sealing element having longitudinally extending grooves;

DESCRIPTION OF THE PREFERRED EMBODIMENTS

Figure 1:
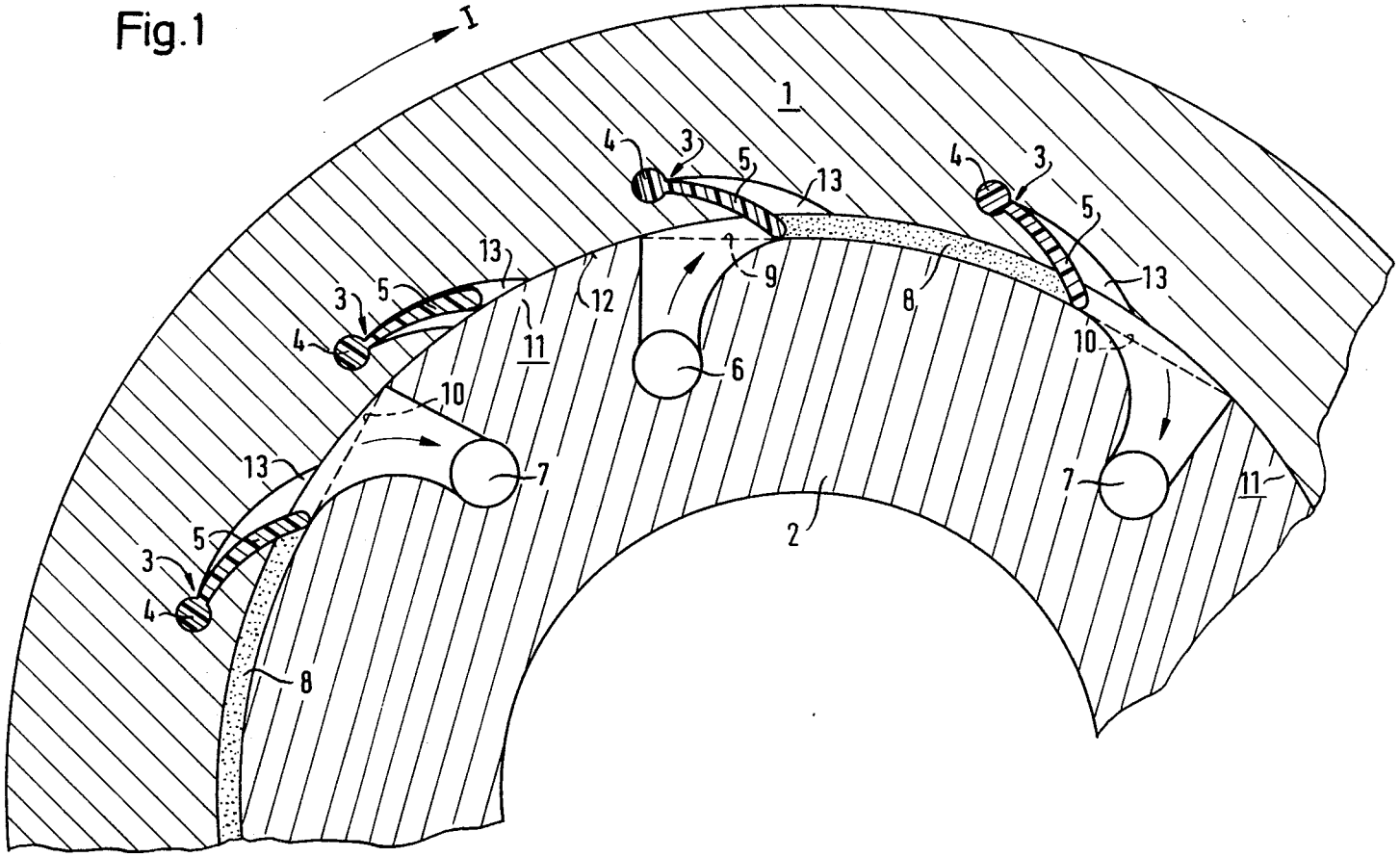
FIG. 1 represents a schematic sectional view, partly fragmented, of the rotary piston engine according to the invention.

Referring to FIG. 1, the rotary pistion engine, which operates as a displacement engine, comprises a rotor 1 running around a stator 2. Said stator 2 has feed ports 6 and discharge ports 7 spaced on its circumference. A workingchamber 8 is provided between each pair of feed and discharge ports 6 and 7. Separating portions or partitions 11 comprising the race 12 are provided between the working chambers. Feed tracks 9 and discharge tracks 10 are arranged in the area of the feed and discharge ports 6 and 7 respectively.

The rotor 1 includes working parts 3 arranged at a distance from each other, which in the embodiment shown are provided as single-bladed sealing elements. These working parts 3 may be made e.g. from plastic and comprise each a stationary bearing portion 4 which may be firmly pressed into the rotor 1. The blade 5 is joined to the stationary bearing portion 4. Moreover, the blade 5 is elastic and contacts the race 12 in the range of the separating portion. In the shown position, the blade 5 is accommodated in a recess 13 in the rotor 1. According to the invention, the blades may be made wholly or partly from spring metal.

As the sealing blade 5 with continued rotation of the rotor 1 slides on the race 12, it passes into the range of the feed track 9 and finally into the working chamber. The medium located in the working chamber will urge against the blade 5 pressing it into closer engagement against the race so that a perfect sealing effect is achieved. The blade 5 leading in the area of the discharge track is likewise firmly pressed against the race by the action of the medium so that the medium is perfectly sealed from the remaining parts of the working chamber.

Figure 2:
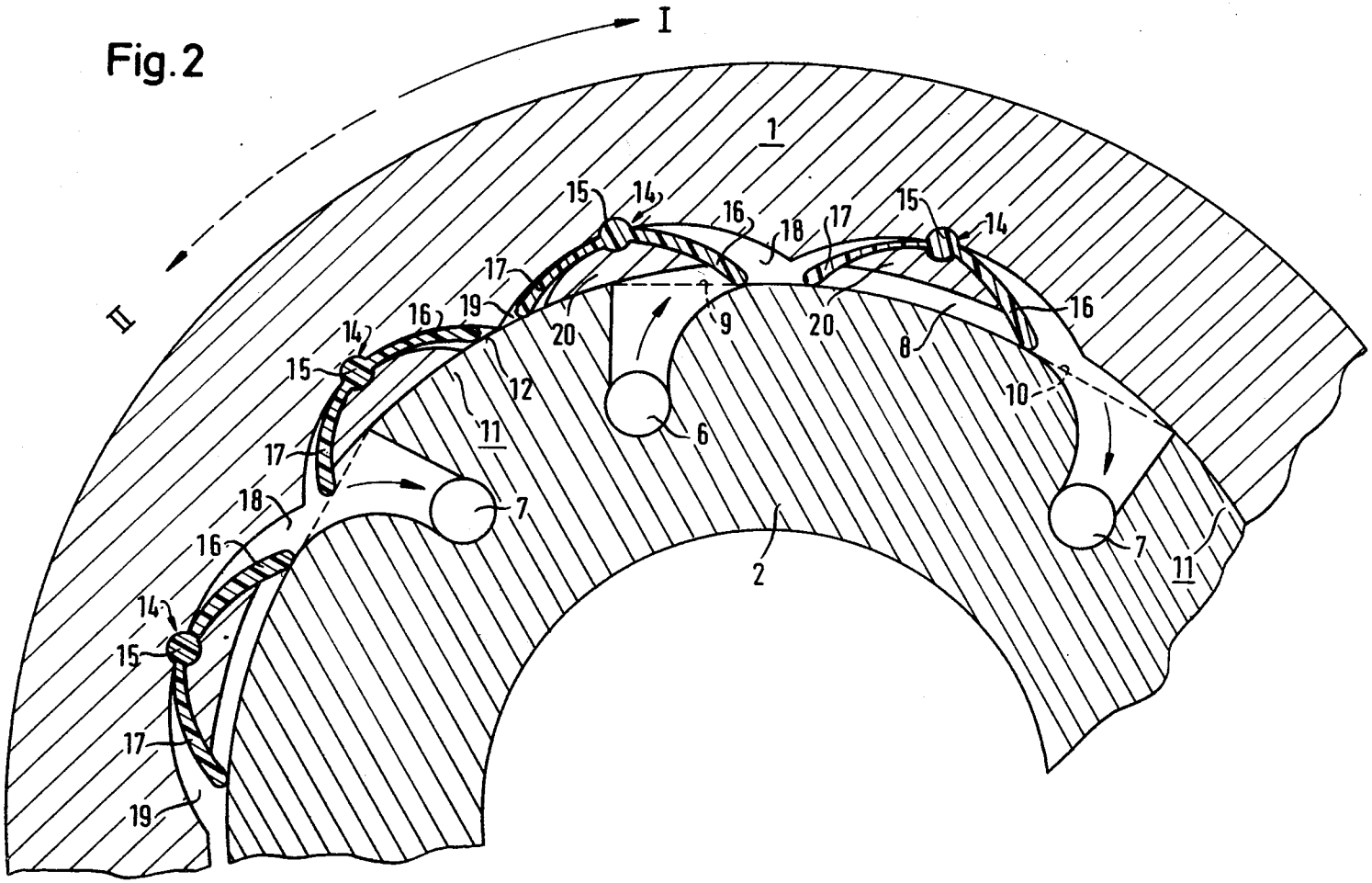
FIG. 2 shows a sectional view of an embodiment comprising two-bladed working parts.

As shown in FIG. 2, it is e.g. possible to provide the working part 14 with two blades, viz. a leading blade 16 and a trailing blade 17 both joining the stationary bearing portion 15. Here, the leading blade 16 is adapted to be received in the forward recess 18 of the rotor 1, the trailing blade 17 being accommodated in the rear recess 19 in the rotor 1 as long as the respective working part is located in the range of the separating portion 11. In this case, the rotor 1 is provided with a support portion 20, with the stationary bearing portion 15 and the sealing element 14 being firmly pressed in between.

This embodiment allows of rotation of the rotor in either direction I and II. With the rotor rotating in the direction of arrow I, the blades 16 of each two-bladed working part will become effective. When the rotor moves in the direction of arrow II, the blades 17 of the two-bladed working parts 14 will engage, with the medium retained in the working chamber firmly pressing the respective blade against the races 9, 10, and 12 respectively provided in the stator 2 so that a perfect sealing action is accomplished by the use of such two-bladed working parts 14.

FIG. 3 illustrates a fragment of the rotor 1 and the stator 2, on a larger scale. The rotor 1 includes a curved recess 13 which continues into a rear recess 21 terminating in an enlarged end portion 22 so that a continuous curve formation is obtained, which can be easily formed by means of a commercially available milling cutter leaving thereby the support portion 20 in the rotor. Once the curved recess has been worked out, a single-bladed working part 3 can be pressed in such that it has its stationary bearing portion firmly positioned in the center of the curved recess with the blade 5 being adapted to pivot so as to swing into the recess 13 as soon as necessary. The rear recess can be closed by appropriate means or may just as well be left open.

As shown in FIG. 4, it is also possible to mount a two-bladed working part 4 into the curved recess with the stationary bearing portion 15 being supported between the trailing blade 17 and the leading blade 16. The leading blade 16 can lodge in in the forward recess 18 and the trailing blade 17, into the rear recess 19. Here, too, a supporting portion 20 of the rotor 1 is maintained so that a perfect and secure connection of the two-bladed working part 14 in the rotor 1 is assured.

According to the direction of the rotor rotation, either the blade 16 or the blade 17 will engage the race 26 of the stator 2.

FIG. 5 shows an embodiment of a single-bladed working part 23 comprising a stationary bearing portion 24 and a blade portion with a sealing lip 27 on its forward end. Here, the recess 25 is worked into the rotor 1 by means of a specially designed tool. Again, the conveying medium will impinge on the sealing lip 27 thus urging it into perfect sealing engagement against the race 26 of the stator 2.

With a view to facilitating the lifting and lowering of the blades, the underside of each blade may be provided with a plurality of adjacent longitudinal grooves 28, as shown in FIG. 6. Said longitudinal grooves 28 extend between the stationary bearing portion and the sealing lip 27. In the course of the rotor rotation relative to the stator 2, the pressure fluid e.g. oil, can pass into the longitudinal grooves 28 thus facilitating lifting of the blade of the working part 23 from the abutment 45.

Such grooves may also be formed in the abutment 45, which assures easy lift-off of the blade and the sealing lip 27 of the working part 23.

Figure 7:
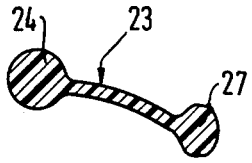
FIGS. 7 and 8 show various variations of the sealing element according to the invention.
Figure 8:
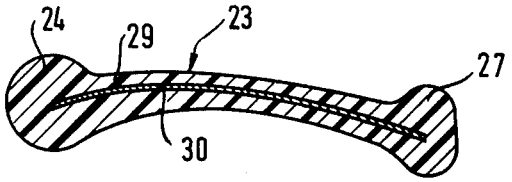

FIG. 7 shows in detail a single-bladed working part including a stationary bearing portion 24 connected with the sealing lip 27 through a blade. As appears from FIG. 8, a double-layer material may be used for the working part, the working part being made e.g. from plastic 29 having a metal member 30 enclosed therein to extend between the stationary bearing portion and the sealing lip 27. This structure assures a working part of especially long working life.

Figure 9:
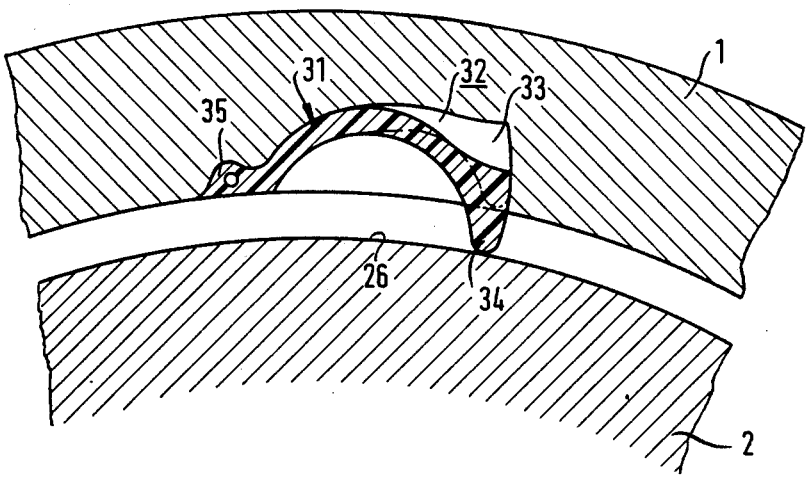
FIG. 9 illustrates a variation of a single-bladed sealing element.

FIG. 9 illustrates a single-bladed working part 31 extending through the entire passage 32 with its stationary bearing portion 35 being supported at the end of the passage 32 in the rotor 1 while its sealing lip 34 extends over the opposite end of the passage 32. In the range of the separating portion, i.e. where the race 26 of the stator 2 engages the rotor 1, the sealing lip 34 and the blade are accommodated within the recess 33. This embodiment, too, assures a perfect sealing of the working chamber against the feed and discharge ports so that an excellent degree of effectiveness is achieved by using working parts of a most simple design.

Figure 10:
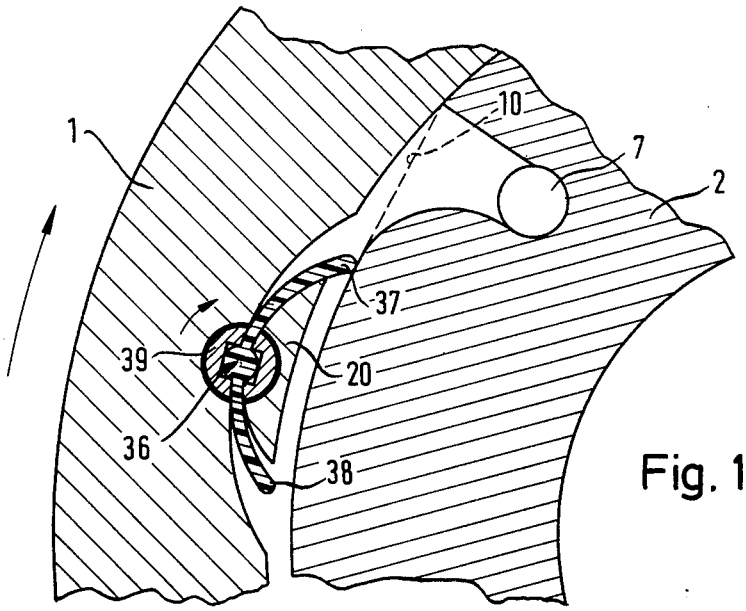
FIGS. 10 and 11 illustrate each an embodiment of a controllable sealing element according to the invention.

As shown in FIG. 10, a two-bladed working part 36 comprising blades 37 and 38 is located with its stationary bearing portion in an oscillating rotary support member 39. Said oscillating rotary support member 39 is adjustable from outside so that either the blade 37 or the blade 38 is in operative connection with the race of the stator 2.

Figure 11:
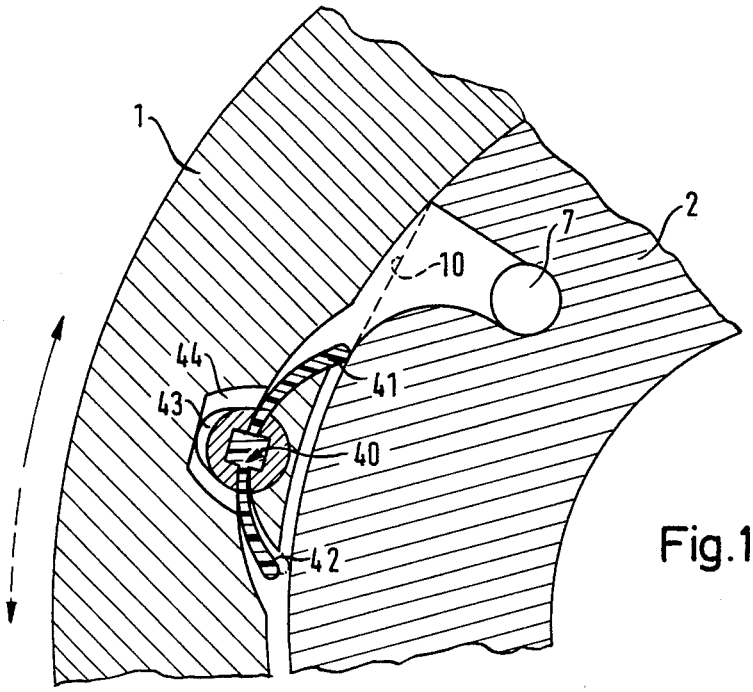

The working part 40 shown in FIG. 11 comprising blades 41 and 42 is carried within a stationary support member having a cam formation 43. Said cam formation 43 cooperates with a recess 44 bringing either the blade 41 or the blade 42 into operative engagement with the stator race. Thus, an advantageous automatic control of the working part is achieved.

Summing up, the working part, which is comprised of a stationary bearing portion and at least one blade, provides at the same time a sealing element affording an increased degree of effectiveness of the engine as a whole, which results in the advantage that any oscillating movements as known from the prior art engines are avoided.

The principle of these particular working parts according to the invention is also applicable to engines having the rotor on the inside or where the working chambers are provided on the inner and outer circumferences of the stator or where at least one lateral surface of the stator is provided with the working chambers. The stator may certainly also be modified to include at least one peripheral recess accommodating the working chambers at its lateral walls or it may have a profile-like design with the profile surfaces including the working chambers.

In any case, also the afore-mentioned variations of the engine permit the use of a sealing member according to the invention with the blade performing its pivoting movement in accordance with the stator race.

What is desired to be secured by Letters Patent of the United States is:

1. A rotary piston engine including a stator and a rotor located concentrically thereto, and sealing elements positioned in the rotor and sealingly engaging a race of the stator, the stator including separating portions in contact with the rotor and having feed and discharge ports arranged between working chambers, said sealing elements comprising:

a stationary cylindrical bearing portion pressed into said rotor;

at least one curved blade connected to said bearing portion and extending forwardly in the direction of rotation of said engine to engage said stator race; and said curved blade adapted to pivot into a curved recess provided in said rotor to accommodate said blade.

2. The engine as set forth in claim 1 wherein:

said curved recess includes an enlarged end portion.

3. The engine as set forth in claim 1, in which each sealing element includes two blades with said stationary bearing portion intermediate said two blades.

4. The engine as set forth in claim 3, in which said two-bladed sealing element is adapted to be controlled in respect of the engagement of either blade with the stator race.

5. The engine as set forth in claim 4, in which the control is effected by means of cam formations, with the stationary bearing portion of the sealing element being disposed in a rotor portion which is adapted for rotary oscillation.

6. The engine as set forth in claim 4, in which the control is effected through the direction of rotation of the rotor.

7. The engine as set forth in claim 1, in which the curved recess includes a passage with an enlarged end portion, the sealing element including a sealing lip and extending through the entire passage and being supported at one end thereof and, at the opposite end either engaging with its sealing lip the stator race or being accommodated within said passage.

8. The engine as set forth in claim 1, in which the working parts are made from plastic.

9. The engine as set forth in claim 1, in which the underside of each blade is provided with longitudinally extending grooves facing said stator race.

10. The engine as set forth in claim 9 in which the grooves extend between the stationary bearing portion and a sealing lip formed at the end of the blade.

11. The engine as set forth in claim 1, in which the sealing elements are made from a two-layer material.

12. The engine as set forth in claim 11, in which the sealing elements are made from a two-layer material, one layer being made from plastic and the other, from metal.

* * * * *